US011994024B2

(12) United States Patent
Trinder

(10) Patent No.: US 11,994,024 B2
(45) Date of Patent: May 28, 2024

(54) DOWNHOLE TAGGANT INJECTOR APPARATUS AND SYSTEM

(71) Applicant: Expro North Sea Limited, Aberdeenshire (GB)

(72) Inventor: Julian Richard Trinder, Southampton (GB)

(73) Assignee: EXPRO NORTH SEA LIMITED, Aberdeenshire (GB)

( * ) Notice: Subject to any disclaimer, the term of this patent is extended or adjusted under 35 U.S.C. 154(b) by 436 days.

(21) Appl. No.: 17/290,112

(22) PCT Filed: Oct. 14, 2019

(86) PCT No.: PCT/GB2019/052923
§ 371 (c)(1),
(2) Date: Apr. 29, 2021

(87) PCT Pub. No.: WO2020/089587
PCT Pub. Date: May 7, 2020

(65) Prior Publication Data

US 2021/0396130 A1 Dec. 23, 2021

(30) Foreign Application Priority Data

Oct. 29, 2018 (GB) ..... 1817602

(51) Int. Cl.
*E21B 47/12* (2012.01)
*E21B 47/11* (2012.01)

(52) U.S. Cl.
CPC ..... *E21B 47/138* (2020.05); *E21B 47/11* (2020.05)

(58) Field of Classification Search
CPC ..... E21B 47/11; E21B 47/138
See application file for complete search history.

(56) References Cited

U.S. PATENT DOCUMENTS

| | | | | |
|---|---|---|---|---|
| 10,914,165 | B2 * | 2/2021 | Pelletier | E21B 47/12 |
| 2003/0056952 | A1 | 3/2003 | Stegemeier | |
| 2013/0017610 | A1 * | 1/2013 | Roberts | C09K 11/06 436/27 |
| 2019/0128081 | A1 | 5/2019 | Ross | |

FOREIGN PATENT DOCUMENTS

WO 2018056990 A1 3/2018

* cited by examiner

*Primary Examiner* — D. Andrews
(74) *Attorney, Agent, or Firm* — Getz Balich LLC

(57) ABSTRACT

A downhole injector apparatus for injecting a taggant into a wellbore includes an injector nozzle outlet and a taggant reservoir in fluid communication with the injector nozzle outlet and configured to hold the taggant to be injected. The apparatus further includes a pressure wave generator configured to apply a pressure wave within the reservoir to expel the taggant from the reservoir through the injector nozzle outlet.

19 Claims, 6 Drawing Sheets

DOWNHOLE TAGGANT INJECTOR APPARATUS AND SYSTEM

This application claims priority to PCT Patent Appln. No. PCT/GB2019/052923 filed Oct. 14, 2019, which claims priority GB Patent Appln. No. 1817602.4 filed Oct. 29, 2018, which are herein incorporated by reference.

BACKGROUND OF THE INVENTION

1. Technical Field

The present disclosure relates to an injector apparatus and method for use in injecting a taggant into a flow of fluid, for example in a wellbore.

2. Background Information

Taggants or tracers are used in the oil and gas industry to impart a detectable signature into a fluid, such as a produced fluid, wherein the tracer provides some indication of a well property or condition. For example, it is known to incorporate tracer material in a solid substrate at a downhole location, wherein the tracer material is released upon exposure to a particular fluid, such as water or oil. The presence of this particular fluid may thus be identified upon detection of the released tracer material, for example at surface.

SUMMARY OF THE INVENTION

An aspect of the present disclosure relates to a downhole injector apparatus for injecting a taggant into a wellbore, comprising: an injector nozzle outlet; a taggant reservoir in fluid communication with the injector nozzle outlet and configured to hold the taggant to be injected; and a pressure wave generator configured to apply a pressure wave within the reservoir to expel the taggant from the reservoir through the injector nozzle outlet.

As the apparatus is for injecting a taggant into a wellbore, the apparatus may be defined as a downhole taggant injector apparatus.

In use, the apparatus may be located at a downhole location in a wellbore and operated to inject the taggant into the wellbore. The taggant may be detected using known techniques, such as via suitable sensors, fluid sampling and the like. As described in more detail below, taggant injection may be performed by the apparatus to support various applications, such as for use in communicating data concerning a wellbore condition to surface.

The ability to inject taggant, rather than, for example, releasing from a solid substrate, may provide a faster response time to an initiation signal or event. Further, more control over the quantity and frequency of release of the taggant may be provided, particularly using the pressure wave generator to provide a driving force to expel taggant form the reservoir. Also, using a pressure wave as the driving force may avoid the requirement for alternative displacement devices, such as pistons, which may require special sealing arrangements, actuators etc.

The taggant may be provided in any suitable form to permit expulsion from the apparatus via the injector nozzle outlet in response to pressure waves generated by the pressure wave generator. The taggant may be provided within or as a fluid to facilitate injection. In some examples the taggant may be provided in the form of a gel.

The taggant may be provided in the form of a paste.

The taggant may be provided within a carrier medium, such as a fluid, gel, paste or the like. In some examples the carrier medium may be selected to have a desired chemistry, for example to permit sufficient containment of the taggant, to be compatible with wellbore chemistry, and the like. The carrier medium may comprise a water based medium. The carrier medium may comprise an oil based medium.

The carrier medium may define or comprise a Newtonian fluid. The carrier medium may define a non-Newtonian fluid. For example, the carrier medium may be selected to provide particular shear properties in response to generated pressure waves within the reservoir. In one example, a shear thinning fluid may be provided, which improves flowability when exposed to one or more pressure waves. In this example the shear thinning fluid may have a propensity to be retained within the reservoir, for example by virtue of its viscosity, until a pressure wave is generated to facilitate shear thinning and improve its ability to flow.

The taggant may be dissolved in the carrier medium. In this example the carrier medium may comprise a solvent, and the taggant defines a solute. The taggant may be mixed with a carrier medium in a suspension. For example, the taggant may define a colloid and provided in a colloidal suspension within the carrier medium.

The taggant may comprise any suitable taggant which permits detection in a required application. In this respect a wide range of different taggants may be used, such as one or more of radioisotopes, chemical markers, optical isomers, ferroelectrics, ferromagnetics, fluorescent dyes, inks, surface tension modifiers, electrical conductivity modifiers, optical speckle additives and the like. The type of taggant used may depend on the carrier medium and the detailed environmental constraints.

As noted above, the taggant may be provided in any suitable form. In this respect, references herein to "taggant" may refer to the taggant itself, and/or any mixture, solution, suspension etc. of the taggant and a carrier medium.

The pressure wave generator may be configured to provide discrete injection events. That is, the pressure wave generator may be operable to expel a quantity of taggant from the reservoir for each operation or series of operations. The apparatus may be configured to permit known quantities of the taggant to be expelled from the reservoir for each operation or series of operations. This controlled injection may be achieved through appropriate construction and/or calibration of the apparatus. For example, specifically selected geometry or dimensions of the injector nozzle outlet, fluid properties of the taggant (e.g., viscosity, density etc.), and properties of the generated pressure waves (e.g., amplitude, period, frequency, etc.) may be controlled or provided to permit known or desired quantities of taggant to be expelled from the reservoir. The pressure wave generator may be configured to generate a pressure wave in the form of a pressure disturbance which propagates within the taggant located within the reservoir, to thus provide a driving force to expel the taggant through the injector nozzle outlet. The pressure wave generator may be configured to generate a shock wave, for example an acoustic shock-wave.

The pressure wave generator may be defined as an actuator.

The pressure wave generator may comprise a mechanical actuator which imparts a physical disturbance to the taggant within the reservoir to generate or initiate a pressure wave. Such a mechanical actuator may comprise a moveable interface which is in contact with the taggant within the reservoir. The mechanical actuator may be electrically operated or driven.

The pressure wave generator may comprise a piezoelectric actuator. The pressure wave generator may comprise a micro-electro mechanical (MEM) actuator.

The pressure wave generator may comprise a thermal actuator which provides a localized heating to the taggant within the reservoir to generate a pressure wave. The thermal actuator may comprise a heater, such as a resistance heater or the like. The thermal actuator may cause a localized phase change of the taggant within the reservoir to generate a bubble which functions to provide the pressure wave used to expel taggant through the injector nozzle outlet. The bubble may propagate from the pressure wave generator towards the injector nozzle outlet, thus causing taggant to be expelled from the reservoir.

The pressure wave generator may comprise an electric-arc discharge actuator which utilizes an electrical arc to generate a pressure wave within the reservoir. Such an electrical arc may cause a localized phase change in the taggant which establishes a pressure wave which propagates through the taggant in the reservoir. The pressure wave generator may be external to the reservoir, and configured to communicate a pressure wave into the reservoir, for example by manipulation or acting on a boundary of the reservoir.

The pressure wave generator may be located within the reservoir, for example in direct interface with the taggant when held within the reservoir. The pressure wave generator may be positioned in close proximity to the injector nozzle outlet, for example immediately adjacent the injector nozzle outlet.

The pressure wave generator may be configured to direct a pressure wave in a desired direction, for example directly towards the injector nozzle outlet. The pressure wave generator may comprise a reflector configured to focus or direct a generated pressure wave in a desired direction. In some examples the ability to direct the pressure wave may increase flexibility in the positioning of the pressure wave generator, for example by allowing the pressure wave generator to be positioned remotely or off-set from the injector nozzle outlet. Further, the ability to direct pressure waves may facilitate use of the pressure wave generator to function in combination with multiple injector nozzle outlets.

The taggant may be retained within the reservoir by a surface tension effect of the taggant across the injector nozzle outlet. That is, the taggant may form a meniscus across the injector nozzle outlet which prevents or resists the taggant from cascading or naturally flowing from the reservoir. The injector nozzle outlet may be configured to permit this surface tension effect to be supported. For example, the injector nozzle outlet may be provided with a desired geometry and/or dimension to permit the taggant to form a meniscus thereacross.

The pressure wave generator may be configured to generate a pressure wave of sufficient magnitude to overcome the surface tension of the taggant across the injector nozzle outlet.

The apparatus may comprise a barrier system which selectively prevents and permits taggant to be expelled from the reservoir. For example the apparatus may comprise a valve which retains taggant in the reservoir until a pressure wave is generated. The apparatus may comprise a pressure balance arrangement for pressure balancing the reservoir relative to an external environment. The external environment may be an ambient environment in which the apparatus is deployed. The external environment may comprise an injection location, such that the reservoir may be pressure balanced with the injection location. This may function to minimize any requirement for the generated pressure waves to overcome any, or any significant, pressure differential between the reservoir and the injection location.

The pressure balance arrangement may permit adjustment in the reservoir pressure in accordance with fluctuations in the external environment pressure. The pressure balance arrangement may accommodate thermal expansion and contraction of the taggant within the reservoir.

The pressure balance arrangement may comprise a pressure transfer structure configured to communicate pressure between the reservoir and the external environment. The pressure transfer structure may fluidly isolate the reservoir from the external environment. The pressure transfer structure may comprise a moveable barrier or interface, such as a piston, bladder or the like.

The pressure balance arrangement may comprise a pressure port adjacent the injector nozzle outlet, wherein the pressure port is configured to communicate pressure from the external environment to the pressure transfer structure.

The apparatus may comprise a single injector nozzle outlet. Alternatively, the apparatus may comprise a plurality of injector nozzle outlets. A plurality of injector nozzle outlets may permit increased injection rates to be achieved. A plurality of injector nozzle outlets may permit different taggants to be injected At least two injector nozzle outlets may be in communication with a common reservoir. In this example a single pressure wave generator may be provided to expel taggant from the common reservoir through the at least two injector nozzle outlet ports. The pressure wave generator may comprise a reflector assembly to direct a pressure wave towards the at least two injector nozzle outlets.

Alternatively, multiple pressure wave generators may be provided within the common reservoir.

At least two injector nozzle outlet ports may be in communication with different reservoirs. Each reservoir may contain the same taggant. Alternatively, each reservoir may contain different taggants.

The apparatus may comprise a controller configured to control operation of the apparatus. For example, the controller may control operation of the pressure wave generator. The controller may control the apparatus in accordance with pre programmed instructions, for example contained within memory associated with the controller. The controller may control the apparatus in accordance with information or signals received from other sources, such as from downhole sensors, downhole tools, transmitted from remote locations, such as other downhole locations, surface etc.

The controller may be in communication with at least one sensor, wherein data form the at least one sensor may be used by the controller to control operation of the apparatus. In such an example the apparatus may permit application in monitoring operations, for example operations in which monitoring of downhole conditions via one or more sensors is required. The at least one sensor may be provided separately from the apparatus, or may be provided as part of the apparatus. The at least one sensor may be configured to sense one or more downhole conditions or properties, such as pressure, temperature, fluid type, conditions associated with a downhole tool, and the like. The sensor may communicate sensed data to the controller, for use in subsequent control of the apparatus.

The apparatus may be configured to inject the taggant into a flow of fluid in a wellbore. In this example the injected taggant may be carried by the fluid flow and detected at a different location. The apparatus may be configured for use in production applications, wherein the flow of fluid may comprise production flow. The apparatus may be configured for use in drilling operations, wherein the flow of fluid may comprise drilling mud flow, for example downward or upward/return mud flow. The apparatus may be configured for use in injection applications, wherein the flow of fluid may comprise injection flow.

The apparatus may be configured to inject taggant into a flow of fluid in a wellbore in accordance with a sensed parameter in the wellbore. The apparatus may be configured to inject taggant into a flow of fluid in a wellbore in accordance with a sensed fluid type (e.g., water, oil, gas etc.) within said flow. For example, a sensed presence of a particular fluid type within the flow of fluid in the wellbore may trigger a response from the apparatus (for example via a controller) to inject taggant into the flow. Detection of the taggant, for example at surface, may confirm that the triggering fluid type is present within the flow, at least at the location of the apparatus. This may feed in to continued well management and control processes.

In some examples multiple downhole injector apparatuses may be provided in different zones within the wellbore, wherein the apparatuses are configured to inject different taggants. This may facilitate an understanding from the detected taggants which regions they originated from. This may provide improved well management and control to be performed.

The apparatus may be configured for use in communicating data within a wellbore. For example, data to be transmitted may be encoded within one or more characteristics of taggant injection into the wellbore. For example, data may be encoded using a pulse-interval modulation technique, in which the interval of discrete injection events or pulses is modulated in accordance with a time regime. The signal may thus be demodulated from the detected taggant pulses, in accordance with the same modulation technique or time regime. For example, detection may be achieved at a suitable sampling rate to ensure sufficient resolution to recognize, or not, individual taggant pulses. In some examples, over-sampling may be used to ensure sufficient detection, or not.

In this example the time regime, or injection rate, may be selected which accounts for diffusion and other dispersion effects of the taggant as it travels with the fluid flow from the point of injection to the point of detection. This may minimize the risk of individual pulses smearing or merging together.

The apparatus may be configured to operate using different signal modulation or encoding techniques, such as encoding signals based on concentration of taggant during an injection event and the like.

The apparatus may be configured to inject different taggants into a wellbore. The ability to inject different taggants may allow multi-bit data symbols to be composed, which may increase the effective data rate. The apparatus may be capable of injecting at least two different taggants. Alternatively, different apparatuses may be used, each containing a unique taggant.

The apparatus may be configured to relay a received signal. For example, the apparatus may be configured to receive a signal, and subsequently transmit a corresponding signal via controlled injection of taggant into a wellbore. The signal received may be a taggant based signal. The signal received may comprise an acoustic signal, electromagnetic signal, pressure pulse and/or the like.

The apparatus may be mountable internally and/or externally of a wellbore tubular, such as production tubing, drill pipe, coiled tubing, casing, liner, and/or the like. The apparatus may be mountable within a mandrel, such as a side-pocket mandrel. The apparatus may be deployable into a wellbore. Such an arrangement may facilitate retrofitting of the apparatus. The apparatus may be retrievable from a wellbore, for example for redressing, refilling with taggant, disposal and/or the like.

The apparatus may comprise or be provided in combination with a baffle adjacent the injector nozzle outlet. The baffle may function to provide a degree of protection or isolation of the injector nozzle outlet from direct fluid impingement by fluid flow in the wellbore.

The apparatus may comprise or be provided in combination with a reception chamber which receives injected taggant and permits release of the injected taggant into a wellbore. The reception chamber may permit a mass release of the injected taggant, once accumulated therein following injection.

The apparatus may comprise a power source. Alternatively, or additionally, the apparatus may be configured to receive power from a remote location.

An aspect of the present disclosure relates to an injector apparatus, comprising: an injector nozzle outlet; a taggant reservoir in fluid communication with the injector nozzle outlet and configured to hold the taggant to be injected; and an actuator for expelling the taggant from the reservoir through the injector nozzle outlet.

An aspect of the present disclosure relates to a method for injecting a taggant into a wellbore using a downhole injector apparatus according to any other aspect.

An aspect of the present disclosure relates to a method for injecting a taggant into a wellbore, comprising generating a pressure wave within a reservoir of taggant which is located in the wellbore, wherein the pressure wave expels the taggant from the reservoir through an injector nozzle outlet.

An aspect of the present disclosure relates to a wellbore telemetry system comprising a downhole injector apparatus according to any other aspect.

The downhole injector apparatus of the telemetry system may be configured to inject taggant into a wellbore subject to fluid flow to form a taggant signal to be conveyed with the fluid flow.

The wellbore telemetry system may be configured to communicate data associated with one or more downhole sensed conditions or parameters, such as downhole fluid conditions, temperature conditions, pressure conditions, downhole tool conditions and the like. In this respect the wellbore telemetry system may define, be provide as part of or in combination with a wellbore monitoring system.

The wellbore telemetry system may comprise a controller configured to control injection of taggant from the downhole injector apparatus in accordance with data to be communicated. For example, data to be communicated or transmitted may be encoded within one or more characteristics of taggant injection into the wellbore. For example, data may be encoded using a pulse-interval modulation technique.

The wellbore telemetry system may comprise a receiver configured to receive a signal. The signal may comprise instructions relating to the operation of the system. The wellbore telemetry system may be configured to relay the received signal in the form of a taggant based signal. The received signal may comprise a taggant based signal, an acoustic signal, an electromagnetic signal, a pressure pulse and/or the like. The downhole injector apparatus may be configured to inject a single taggant type.

Alternatively, the downhole injector apparatus may be configured to inject multiple different taggants. This may permit an increase in data rates to be achieved. The system may comprise a detector apparatus for detecting a taggant signal injected in to the wellbore. The detector apparatus may be located at a downhole location. The detector apparatus may be located at or near the surface.

An aspect of the present disclosure relates to a method for communicating in a wellbore subject to fluid flow, comprising controlling a downhole injector apparatus according to any other aspect to inject a taggant into the fluid flow to form a taggant signal which is conveyed with the fluid flow.

The method may comprise encoding the taggant signal via one or more characteristics of taggant injection into the wellbore. For example, data may be encoded using a pulse-interval modulation technique.

The method may comprise receiving a signal, and relaying said signal in the form of a taggant based signal.

An aspect of the present disclosure relates to a wellbore telemetry system comprising a downhole injector apparatus configured to inject a taggant into a wellbore subject to fluid flow to form a taggant signal to be conveyed with the fluid flow.

Various aspects presented above relate to an injector apparatus and associated methods and systems which inject a taggant into a wellbore. However, the apparatus, methods and systems may not necessarily be restricted for use in a wellbore, and may be used in any flow application, including topside applications, pipeline applications and the like.

BRIEF DESCRIPTION OF THE DRAWINGS

These and other aspects of the present disclosure will now be described, by way of example only, with reference to the accompanying drawings, in which.

DETAILED DESCRIPTION OF THE INVENTION

Figure 1:
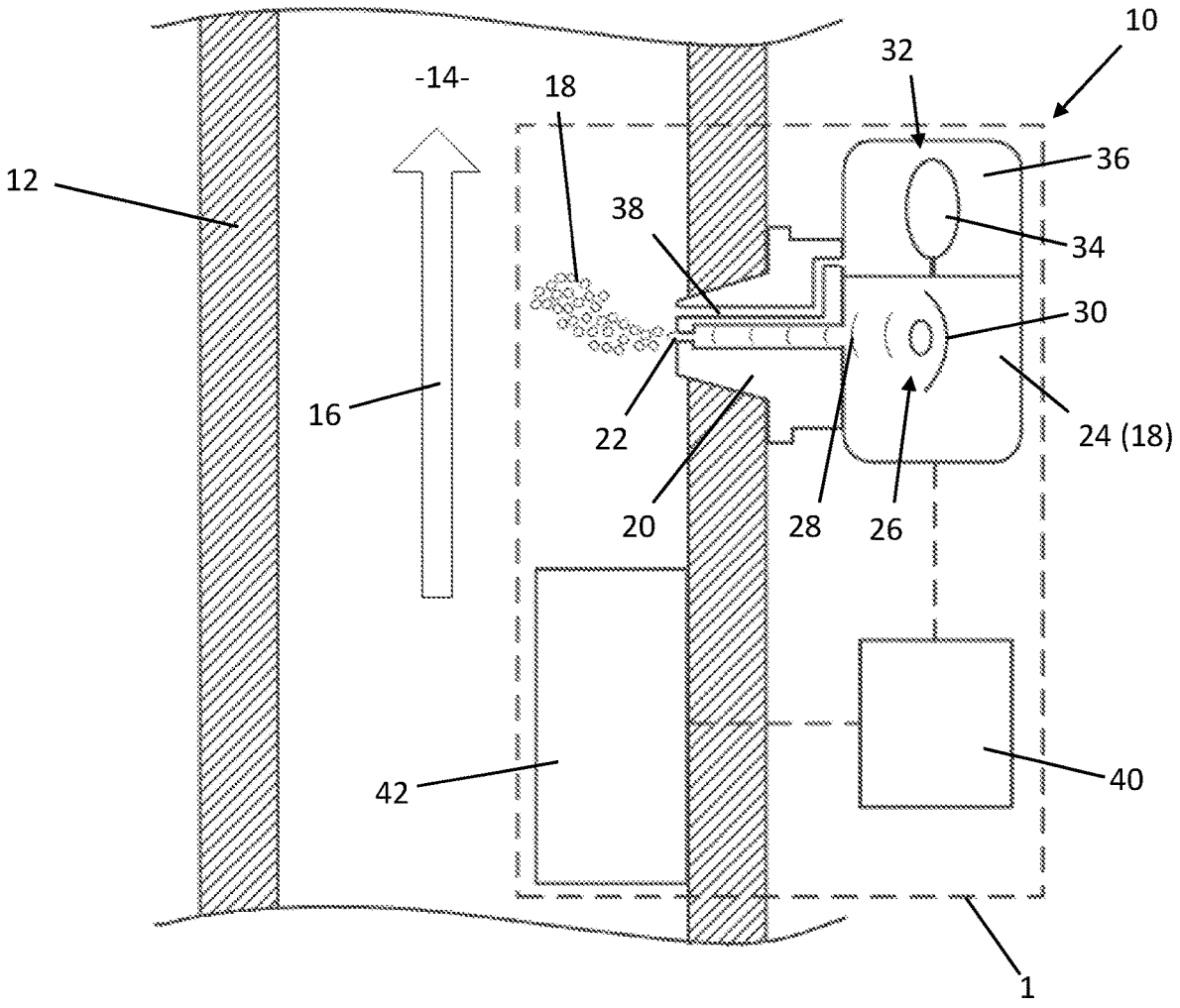
FIG. 1 is a diagrammatic illustration of a downhole taggant injector apparatus in use injecting a taggant into a wellbore.

A diagrammatic illustration of a downhole injector apparatus, generally identified by reference numeral 10, is shown in FIG. 1. The apparatus 10 is secured to a wellbore tubular 12 (e.g., production tubing, coiled tubing, drill pipe, casing, liner and/or the like) which defines a flow path 14 containing fluid flow 16, and is configured to inject a volume of a taggant 18 into said tubular flow path 14 thus to be carried by the fluid flow 16 to be detected, as required, at a different location.

The apparatus 10 comprises an injector nozzle 20 which includes an injector nozzle outlet 22 which is in communication with the tubular flow path 14. The apparatus 10 further comprises a taggant reservoir 24 which contains a volume of taggant 18, wherein the reservoir 24 is in fluid communication with the injector nozzle outlet 22. The taggant 18 may be provided in any suitable form to permit expulsion from the apparatus 10 via the injector nozzle outlet 22. For example, the taggant may be provided in a colloidal suspension within a carrier medium. Further, the taggant may comprise any suitable taggant which permits detection in a required application. In this respect a wide range of different taggants may be used, such as one or more of radioisotopes, chemical markers, optical isomers, ferroelectrics, ferromagnetics, fluorescent dyes, inks, surface tension modifiers, electrical conductivity modifiers, optical speckle additives and the like.

A pressure wave generator or actuator 26 is provided within the reservoir 24 and functions to apply a pressure wave 28 (e.g., an acoustic shock-wave) within the reservoir 24 to expel the taggant 18 through the injector nozzle outlet 22. The pressure wave generator 26 may be configured to generate a pressure wave 28 in the form of a pressure disturbance which propagates within the taggant 18 located within the reservoir 24, to thus provide a driving force to expel the taggant 18 through the injector nozzle outlet 22.

The pressure wave generator 26 may comprise any suitable actuator, such as a mechanical actuator, thermal actuator, electrical actuator, and/or the like.

In the illustrated example the pressure wave generator 26 comprises an optional reflector 30 which functions to direct generated pressure waves 28 towards the injector nozzle outlet 22.

The apparatus 10 further comprises a pressure balance arrangement 32 for pressure balancing the reservoir 24 relative to the flow path 14. The pressure balance arrangement 32 comprises an inflatable bladder 34 which is in pressure communication with the reservoir 24, such that the pressure internally of the bladder 34 is balanced with that of the reservoir 24. The bladder 34 is positioned within a plenum chamber 36 which is in pressure communication with the tubular flow path 14 via pressure port or channel 38, such that the pressure within the plenum chamber 36 which acts on the bladder 34 is balanced with the tubular flow path 14. Thus, pressure transfer may be permitted from the flow path 14 to the reservoir 24 via the pressure channel 38, plenum chamber 36 and inflatable bladder 34.

The pressure balance arrangement 32 may be provided in multiple alternative forms, such as via a piston barrier arrangement, bellows arrangement and/or the like.

The apparatus 10 may comprise or be provided in combination with a controller 40 configured to control operation of the apparatus 10, for example to control operation of the pressure wave generator 26. The controller 40 may control the apparatus 10 in accordance with pre-programmed instructions, for example contained within memory (not shown) associated with the controller 40.

Alternatively, or additionally, the controller 40 may control the apparatus 10 in accordance with information or signals received from other sources, such as from a downhole sensor 42. Such a sensor 42 may form part of the apparatus 10 (illustrated by the broken outline box 1), or alternatively may be provided separately, for example as an independent sensor and/or as part of a separate tool (not shown). While a single sensor 42 is illustrated, multiple sensors may be present for performing multiple similar or different sensing operations.

In the present example the apparatus 10 may permit application in monitoring operations, for example operations in which monitoring of downhole conditions via the sensor 42 is performed.

Figure 2A:
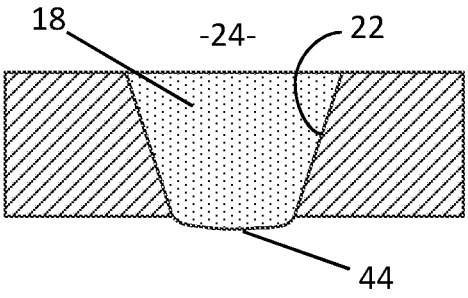
FIGS. 2A to 2C provide sequential illustrations of a taggant being ejected from an injector nozzle of the apparatus of FIG. 1.

As illustrated in FIG. 2A, the taggant 18 may be retained within the reservoir 24 by a surface tension effect of the taggant 18 across the injector nozzle outlet 22. That is, the taggant 18 may form a meniscus 44 across the injector nozzle outlet 22 which prevents or resists the taggant 18 from cascading or naturally flowing from the reservoir 24. The injector nozzle outlet 18 may be configured to permit this surface tension effect to be supported. For example, the injector nozzle outlet 18 may be provided with a desired geometry and/or dimension to permit the taggant to form the meniscus 44 thereacross. A person of skill in the art would readily be able to provide this surface tension effect based on known principles.

Figure 2B:
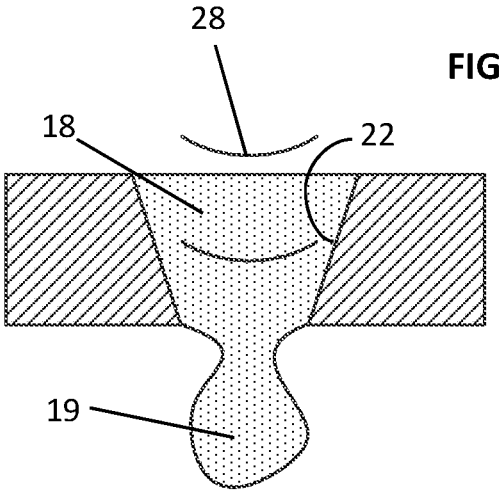
Figure 2C:
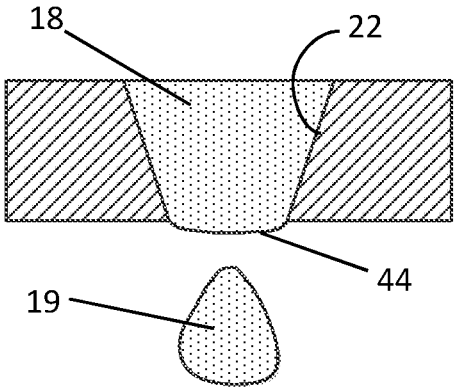

When a pressure wave 28 is generated, as shown in FIG. 2B, the surface tension is overcome such that a taggant droplet 19 begins to be ejected, wherein the droplet 19 eventually breaks free, as shown in FIG. 2C, with the surface tension again forming a meniscus 44.

Figure 3:
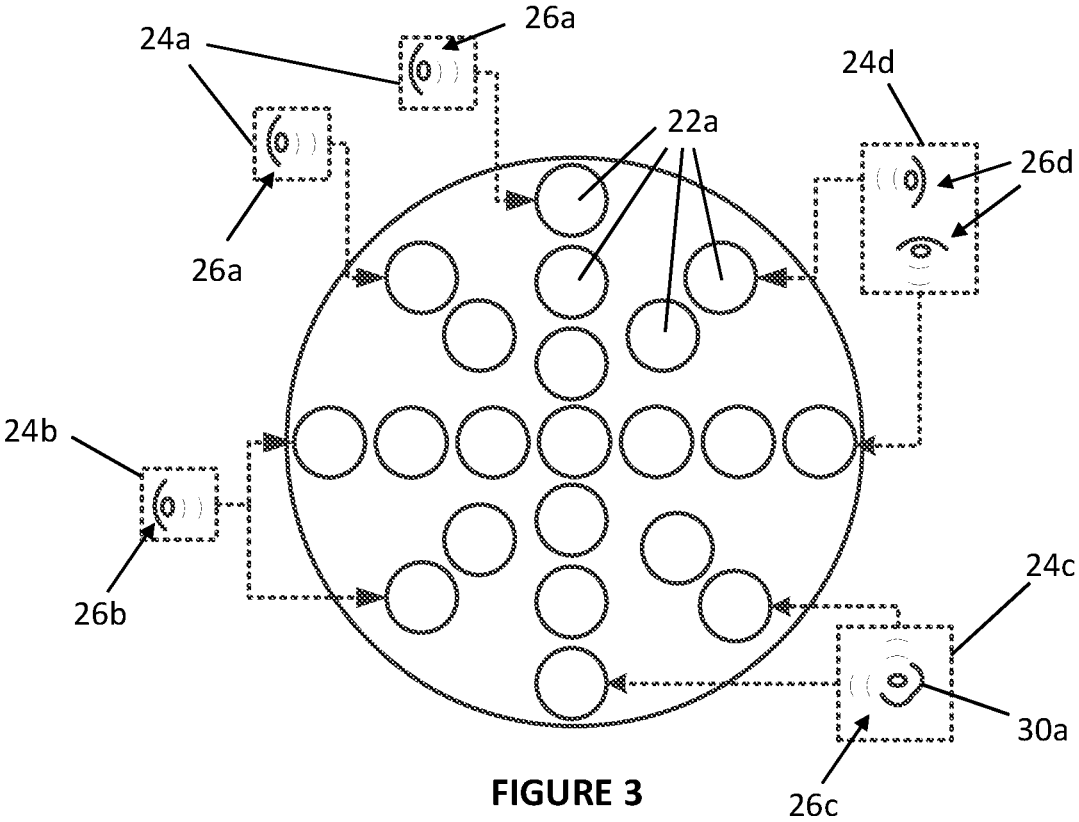
FIG. 3 diagrammatically illustrates a number of example options of using multiple nozzle outlets in a downhole taggant injector apparatus.

The apparatus 10 may include a single injector nozzle outlet 22, as illustrated in FIG. 1. However, in other examples multiple injector nozzle outlets 22*a* may be provided, as illustrated in FIG. 3. In this respect the number, form and arrangement of outlets 22*a* in FIG. 3 is merely exemplary. FIG. 3 also provides a diagrammatic illustration of example options of taggant reservoirs and pressure wave generators which may operate in conjunction with such multiple injector nozzle outlets 22*a*. For example, two or more nozzle outlets may be supplied via separate reservoirs 24*a* which include respective pressure wave generators 26*a*. Alternatively/additionally, two or more nozzle outlets may be supplied via a single reservoir 24*b* using a single pressure wave generator 26*b*, or in the case of single reservoir 24*c* using a single pressure wave generator 26*c* which includes a specially formed reflector 30*a* which appropriately directs pressure waves to the individual nozzle outlets. In a further example, a single reservoir 24*d* may communicate with two or more nozzle outlets, wherein the single reservoir 24*d* includes a plurality of pressure wave generators 26*d*.

As noted above, the apparatus 10 may be controlled in accordance with information or signals received from other sources, such as from a downhole sensor 42. One such example operation will now be described with reference to FIG. 4, which illustrates the apparatus 10 being used in a wellbore telemetry operation, communicating data from a downhole location to surface 50. In this example the wellbore tubular 12 may define or comprise production tubing, and the flow 16 may comprise production flow which is directed towards a wellhead facility 52 at surface 50. However, it should be recognized that any flowing application may also support data communication using the apparatus 10, such as mud flow during drilling operations, injection flow during injection operations, and the like.

The sensor 42 will sense data associated with one or more downhole conditions, such pressure, temperature, fluid properties, fluid types (e.g., water cut), and/or the like. Alternatively/additionally, the sensor may sense data associated with the condition of a separate tool or apparatus located downhole. Such data will be communicated to the controller 40 which will function as a signal modulator to generate suitable instructions to the pressure wave controller 26 to facilitate taggant injection in accordance with the data to be transmitted. In this way, the data signal to be transmitted may be encoded within one or more characteristics of taggant injection into the wellbore.

In the example illustrated, the data is encoded in a taggant based signal using a pulse-interval modulation technique, in which taggant pulses or clouds 18*a-e* are injected at specifically spaced time intervals. The taggant clouds 18*a-e* are then transported to surface within the flow 16. A suitable sensor arrangement 54 is provided at or near the surface for detecting the taggant clouds 18*a-e*, and communicates received data to a surface controller 56, which may function to de-modulate the signal to extract the encoded transmitted data. Such surface detection may be performed to accommodate the same modulation technique or time regime used in generating the taggant signal. For example, detection may be achieved at a suitable sampling rate to ensure sufficient resolution to recognize, or not, individual taggant pulses 18*a-e*.

In this example the time regime, or injection rate, may be selected which accounts for diffusion and other dispersion effects of the taggant pulses 18*a-e* as they travel with the fluid flow 16 from the point of injection to the point of detection. This may minimize the risk of individual pulses smearing or merging together.

Figure 4:
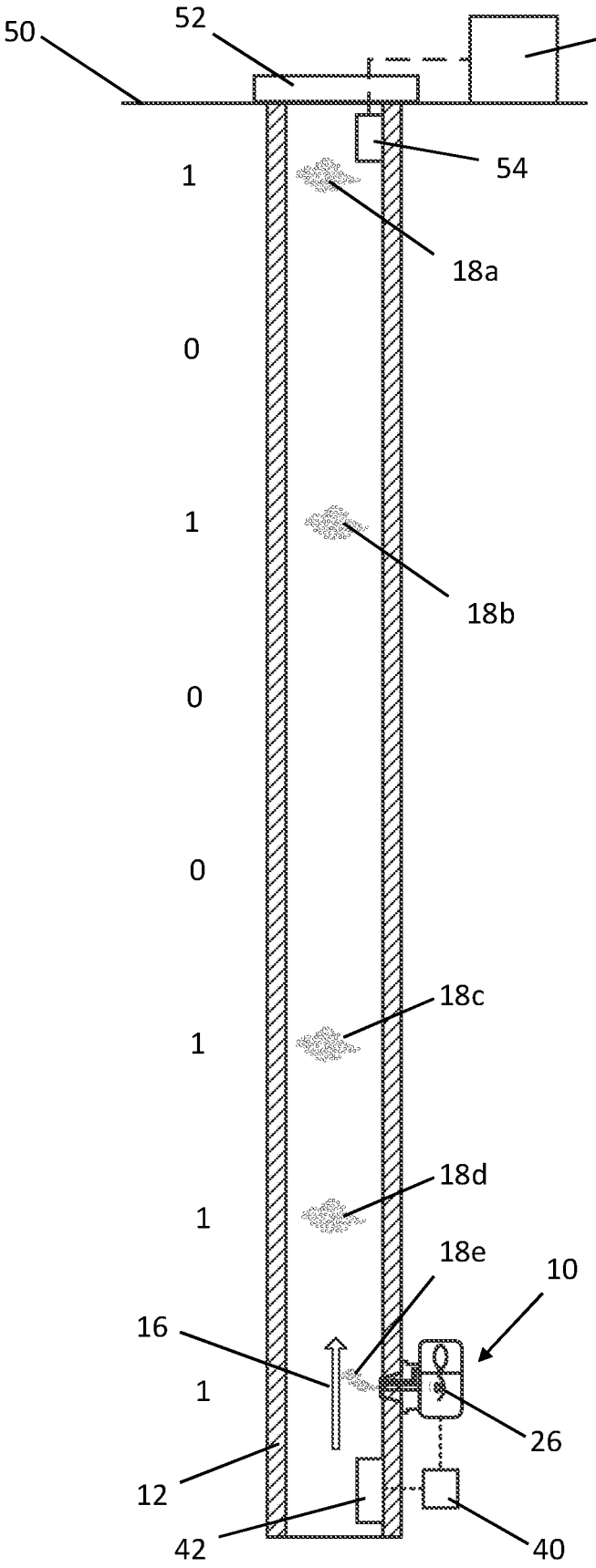
FIG. 4 diagrammatically illustrates the apparatus of FIG. 1 in use in a wellbore taggant telemetry system.
Figure 5:
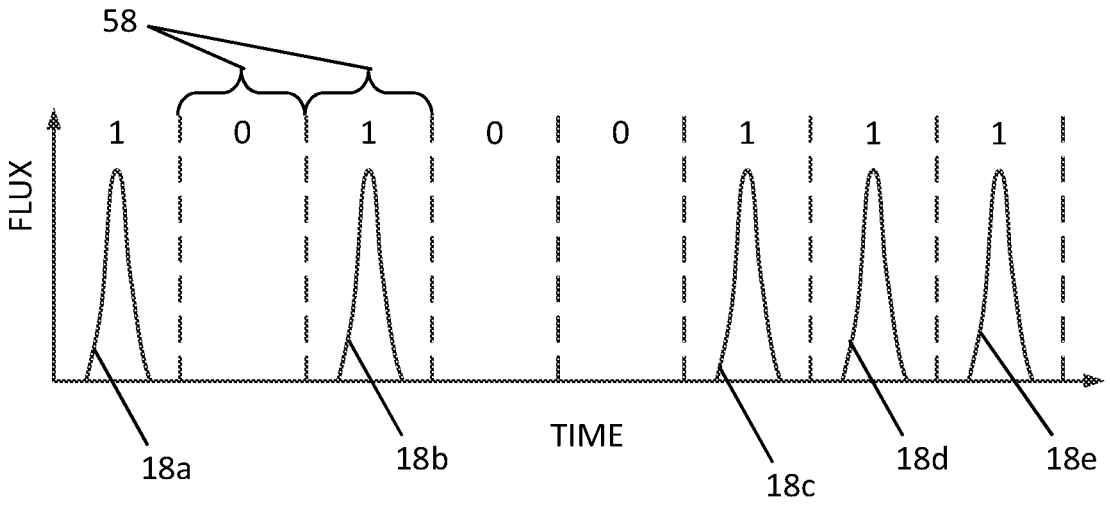
FIG. 5 illustrates an exemplary time domain plot of surface detected taggant using the system of FIG. 4.

Reference is additionally made to FIG. 5 which illustrates an exemplary time domain plot of surface detected taggant clouds 18*a-e* using the system of FIG. 4. As illustrated, sampling is achieved in even time windows 58 at a sampling frequency which corresponds to the taggant injection frequency. A detected taggant cloud within a time window 58 may represent one binary digit (e.g., "1"), whereas no taggant detection within a time window 58 may represent a different binary digit (e.g.,"0").

Figure 6A:
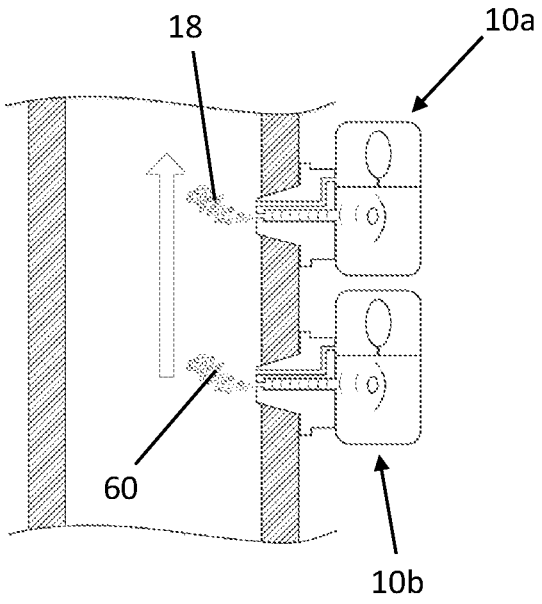
FIGS. 6A and 6B diagrammatically illustrate multiple downhole taggant injectors in use in a wellbore.
Figure 6B:
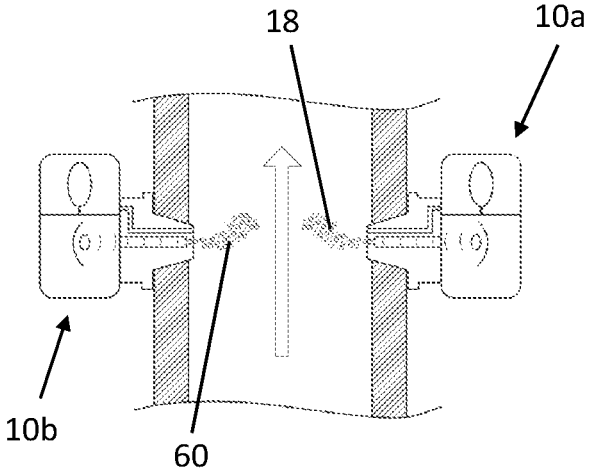

In this communication regime the data rate achievable may be dictated by the flow rate and the required injection intervals to minimize cloud smearing. In some examples, for example as illustrated in FIGS. 6A and 6B, the effective data rate of the scheme may be increased by using two injector apparatuses 10*a*, 10*b* which inject different taggants 18, 60. This may permit multi-bit data signals to be composed and transmitted. In the examples of FIGS. 6A and 6B separate apparatuses 10*a*, 10*b* are illustrated. However, a single apparatus may be provided which permits injection of different taggants. Further, while the injection of two different taggants 18, 60 is illustrated, multiple different taggant type injection may be accommodated.

In FIG. 6A taggant injection is achieved at different axial locations along a bore, whereas in FIG. 6B taggant injection is achieved at a common axial location while at different circumferential locations around a bore. Of course, a combination of the two examples in FIGS. 6A and 6B may be possible, in which taggant injection is achieved at different axial and circumferential locations.

Figure 7:
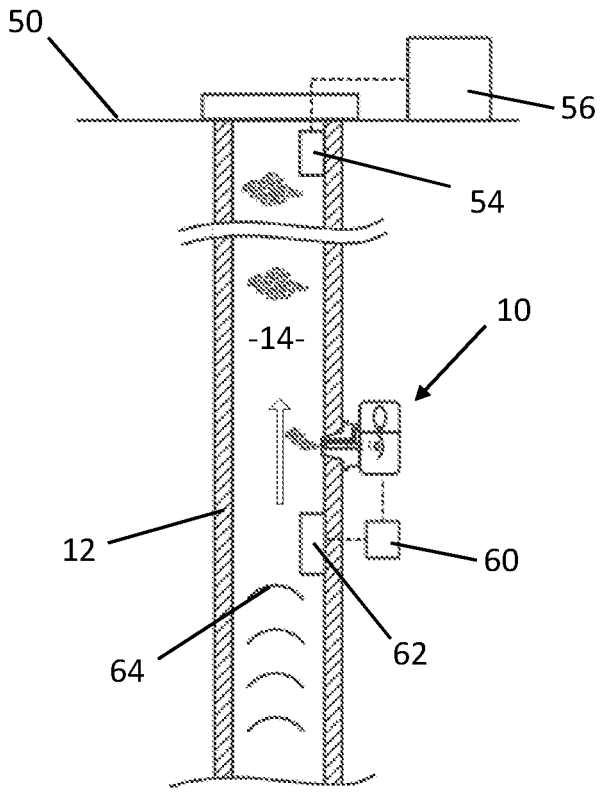
FIG. 7 diagrammatically illustrates a hybrid wellbore telemetry system.

In the examples presented above, a sensor 42 may function to sense downhole properties or conditions which are transmitted to surface 50 using a taggant based signal. However, any other form of data may be transmitted, such as illustrated in FIG. 7. In this example a receiver 62 is provided within the tubular 12 which detects a signal 64 transmitted from a remote location along the flow path 14, for example from further downhole. The received signal 64 may be of any type, such as acoustic, pressure pulse, electromagnetic and the like. Further, although the signal 64 is shown being transmitted along the flow path 14 of the tubular 12, the signal 64 may alternatively, or additionally, be transmitted through the wall of the tubular 12.

Once the signal 64 is received by receiver 62, data is communicated to the controller 40, which then controls the apparatus 10 as required to initiate taggant injection and transmission of a taggant based signal to be received at surface 50 by sensor arrangement 54 and surface controller 56. In this example the data encoded within the taggant signal corresponds to the message encoded within the received signal 64. As such, the apparatus 10 may function as a signal relay device. Such an arrangement may provide a hybrid telemetry system.

Figure 8:
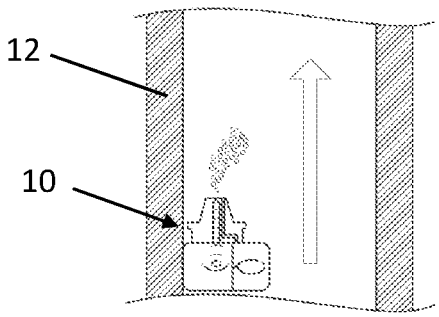
FIGS. 8 and 9 illustrate alternative examples of a downhole taggant injector apparatus.
Figure 9:
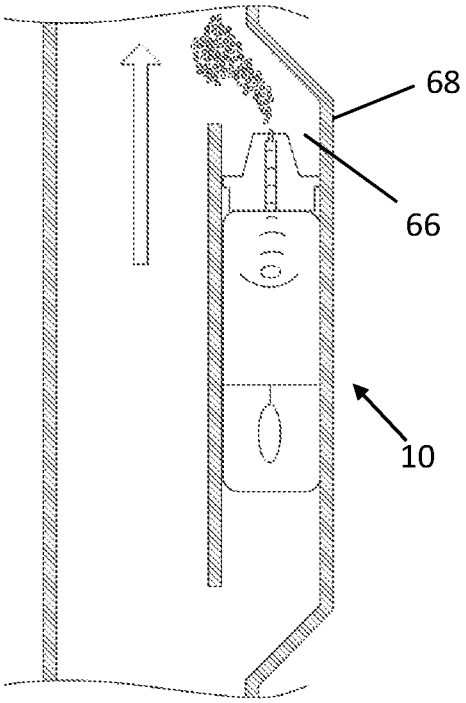

In the example first presented above in FIG. 1 the injector apparatus 10 is located external to the tubular 12. However, in alternative examples the apparatus 10 may be mounted internally of the tubular 12, for example as illustrated in FIG. 8. Further, as illustrated in FIG. 9, the apparatus 10 may be capable of being mounted within a side-pocket 66 of a side-pocket mandrel 68 which is connected to or forms part of a tubular. In this example the apparatus 10 may be sized and configured to be received within the side-pocket 66. Further, the apparatus 10 may be configured to be retrieved (as might be the case in any of the examples described herein), for example using known wireline tools, such as kick-over tools.

Figure 10:
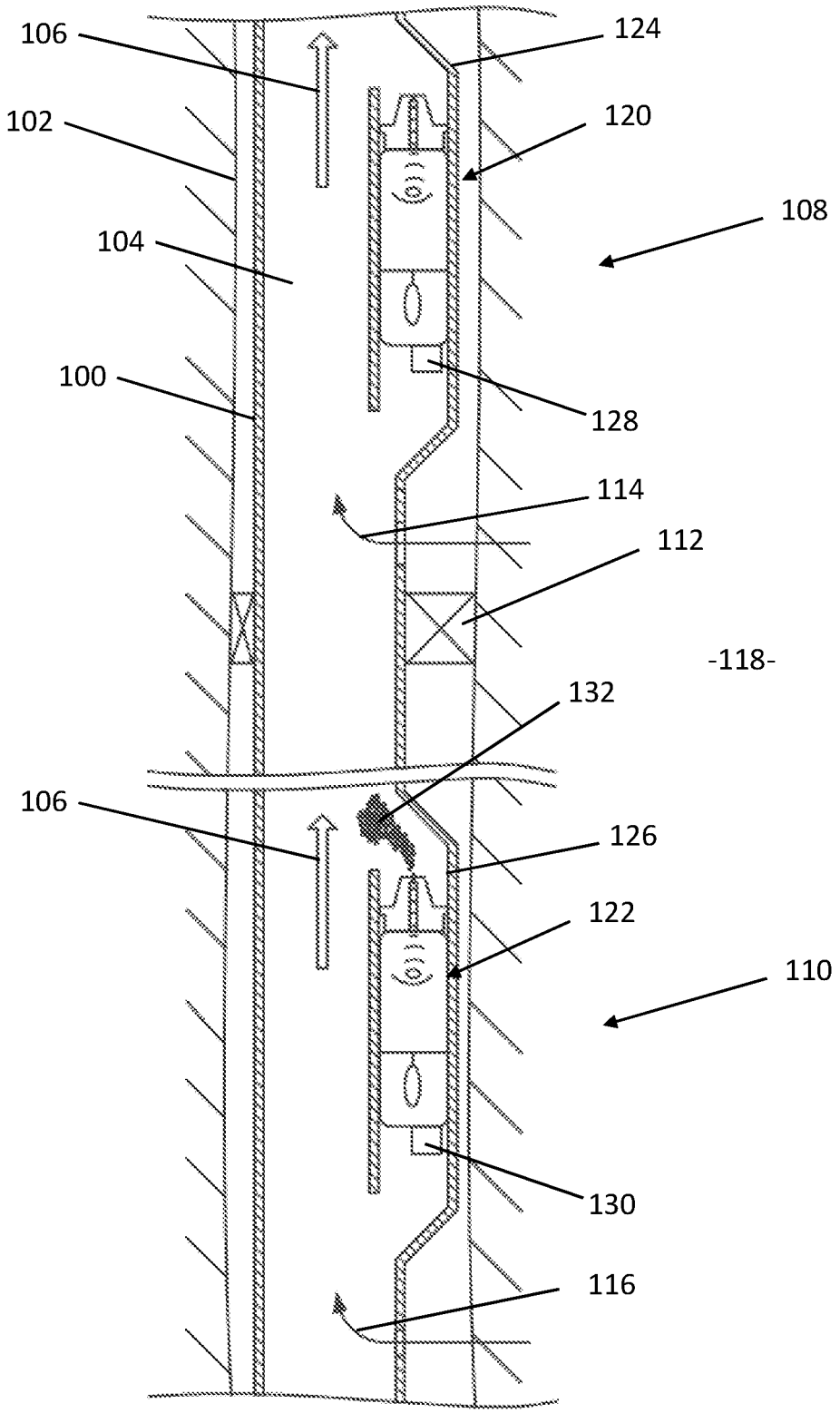
FIG. 10 diagrammatically illustrates a multi-zone wellbore completion which incorporates multiple downhole taggant injectors which detect the presence of a particular fluid.

Although the apparatus described above may be used in a wellbore telemetry application, multiple different uses are possible. An example of an alternative use will now be described with reference to FIG. 10 which illustrates a production string 100 located within a wellbore 102, wherein the production string 100 defines a flow path 104 for accommodating production flow 106. In the present example the production string 100 accommodates production from multiple zones 108, 110 isolated from each other via a suitable packer 112. Thus, inflow 114, 116 into the flow path 104 may be accommodated from different regions of a formation 118.

An injector apparatus 120, 122 is mounted within each zone 108, 110 of the production string 100, specifically within respective side pocket mandrels 124, 126 of the production string 100. Each injector apparatus 120, 122 may be provided in a similar manner to apparatus 10 described above, and as such no further description will be given. However, in the present example each injector apparatus 120, 122 includes a respective water sensor 128, 130. During normal oil (and/or gas) production the injector apparatuses 120, 122 may remain inactive. However, upon detection of water being produced, for example in zone 110, such water production will be detected by sensor 130, and thus cause injector apparatus 122 to inject a unique taggant 132 into the flow 106. Detection of the taggant 132, for example at surface, can thus be used to confirm not only that water has been produced, but due to the uniqueness of the taggant 132, the zone 110 in which water breakthrough has occurred. This may therefore permit improved well management decisions to be taken, for example to isolate or choke production from zone 110.

It should be understood that the examples provided herein are indeed examples, and that various modifications may be made. For example, the principles of the present disclosure may permit use in any number of applications. Further, while a downhole application is presented as an example, the principles of the present disclosure may have utility in any flowing system, such as in topside applications, pipelines etc.

The invention claimed is:

1. A downhole injector apparatus for injecting a taggant into a wellbore, comprising:

an injector nozzle outlet;

a taggant reservoir in fluid communication with the injector nozzle outlet and configured to hold the taggant to be injected;

and a pressure wave generator configured to produce a pressure wave configured to propagate through the taggant within the reservoir to expel the taggant from the reservoir through the injector nozzle outlet, wherein the taggant is retained within the reservoir by a surface tension effect of the taggant across the injector nozzle outlet, and the pressure wave generator is configured to generate a pressure wave of sufficient magnitude to overcome the surface tension of the taggant across the injector nozzle outlet.

2. The downhole injector apparatus according to claim 1, wherein the pressure wave generator is configured to generate a pressure wave in the form of a pressure disturbance which propagates within the taggant located within the reservoir, to provide a driving force to expel the taggant through the injector nozzle outlet.

3. The downhole injector apparatus according to claim 1, wherein the pressure wave generator is configured to generate an acoustic shock wave.

4. The downhole injector apparatus according to claim 1, wherein the pressure wave generator comprises a mechanical actuator which imparts a physical disturbance to the taggant within the reservoir to generate a pressure wave.

5. The downhole injector apparatus according to claim 1, wherein the pressure wave generator comprises a thermal actuator which provides a localized heating to the taggant within the reservoir to generate a pressure wave.

6. The downhole injector apparatus according to claim 1, wherein the pressure wave generator comprises a reflector configured to direct a generated pressure wave in a desired direction.

7. The downhole injector apparatus according to claim 1, comprising a pressure balance arrangement for pressure balancing the reservoir relative to an external environment.

8. The downhole apparatus according to claim 7, wherein the pressure balance arrangement comprises a pressure transfer structure configured to communicate pressure between the external environment and the reservoir.

9. The downhole apparatus according to claim 8, wherein the pressure transfer structure fluidly isolates the reservoir from the external environment.

10. The downhole apparatus according to claim 1, comprising a plurality of injector nozzle outlets.

11. The downhole apparatus according to claim 10, wherein at least two injector nozzle outlets are in communication with a common reservoir, and wherein a single pressure wave generator is provided to expel taggant from the common reservoir through the at least two injector nozzle outlet ports.

12. The downhole apparatus according to claim 11, wherein the single pressure wave generator comprises a reflector assembly to direct a pressure wave towards the at least two injector nozzle outlets.

13. The downhole apparatus according to claim 10, wherein at least two injector nozzle outlet ports are in communication with different reservoirs of the apparatus.

14. The apparatus according to claim 1, comprising a controller configured to control operation of the apparatus, wherein the controller is in communication with at least one sensor, wherein data from the at least one sensor is used by the controller to control operation of the apparatus.

15. The apparatus according to claim 1, configured to inject taggant into a flow of fluid in a wellbore in response to a sensed fluid type.

16. The apparatus according to claim 1, configured for use in conveying telemetry data within a wellbore, wherein data to be transmitted is encoded within one or more qualities or characteristics of taggant injection into the wellbore.

17. A method for injecting a taggant into a wellbore, comprising generating a pressure wave configured to propagate within taggant disposed within a reservoir, wherein the reservoir of taggant is located in the wellbore, and wherein the pressure wave is further configured to cause taggant to be expelled from the reservoir through an injector nozzle outlet, wherein the taggant is retained within the reservoir by a surface tension effect of the taggant across the injector nozzle outlet, and the pressure wave generated is of sufficient magnitude to overcome the surface tension of the taggant across the injector nozzle outlet.

18. A wellbore telemetry system comprising:

a downhole injector apparatus according to claim 1; and a controller configured to control injection of taggant from the downhole injector apparatus in accordance with data to be communicated.

19. A method for communicating in a wellbore subject to fluid flow, comprising controlling a downhole injector apparatus according to claim 1 to inject a taggant into the fluid flow to form a taggant signal which is conveyed with the fluid flow.

* * * * *